US009796190B2

(12) United States Patent
Sanaei et al.

(10) Patent No.: US 9,796,190 B2
(45) Date of Patent: Oct. 24, 2017

(54) SHEET FEED MECHANISM FOR PRINTER HAVING WIDE PRINT ZONE

(71) Applicant: Memjet Technology Ltd., Dublin (IE)

(72) Inventors: Kianoush Mir Sanaei, San Diego, CA (US); Makomo Tsubono, North Ryde (AU); Reza Moghaddasian, San Diego, CA (US)

(73) Assignee: MEMJET TECHNOLOGY LTD. (IE)

( * ) Notice: Subject to any disclaimer, the term of this patent is extended or adjusted under 35 U.S.C. 154(b) by 0 days.

(21) Appl. No.: 15/220,252

(22) Filed: Jul. 26, 2016

(65) Prior Publication Data

US 2017/0057216 A1 Mar. 2, 2017

Related U.S. Application Data

(60) Provisional application No. 62/213,265, filed on Sep. 2, 2015.

(51) Int. Cl.

| | |
|---|---|
| ***B41J 13/10*** | (2006.01) |
| ***B41J 2/175*** | (2006.01) |
| ***B41J 3/54*** | (2006.01) |
| ***B41J 11/00*** | (2006.01) |
| ***B41J 11/20*** | (2006.01) |
| *B41J 2/01* | (2006.01) |

(52) U.S. Cl.

CPC ..... *B41J 3/543* (2013.01); *B41J 2/17503* (2013.01); *B41J 11/001* (2013.01); *B41J 11/20* (2013.01); *B41J 13/103* (2013.01); *B41J 2002/012* (2013.01)

(58) Field of Classification Search

CPC . B41J 2/155; B41J 2/2146; B41J 2/515; B41J 2/17503; B41J 2/2103; B41J 13/0054; B41J 13/103; B41J 13/12; B41J 17/02; B41J 17/18; B41J 17/20

See application file for complete search history.

(56) References Cited

U.S. PATENT DOCUMENTS

| | | | | |
|---|---|---|---|---|
| 8,888,240 | B1 * | 11/2014 | Kasiske, Jr. | B41J 2/155 347/4 |
| 9,090,424 | B1 * | 7/2015 | Armbruster | B41J 11/00 |
| 2008/0218710 | A1 * | 9/2008 | Taira | G03B 27/52 355/30 |

* cited by examiner

*Primary Examiner* — Geoffrey Mruk
(74) *Attorney, Agent, or Firm* — Cooley LLP

(57) ABSTRACT

A printer includes: a first fixed printhead having a respective first print zone; a first platen positioned in the first print zone; a second fixed printhead positioned downstream of the first printhead having a respective second print zone; a second platen positioned in the second print zone; an input roller assembly configured for feeding media sheets along a downward trajectory towards the first platen; an intermediary roller assembly positioned between the first and second platens and configured for receiving the media sheets from the first platen and feeding the media sheets along a downward trajectory towards the second platen; and an exit roller assembly for receiving the media sheets from the second platen. The second platen is positioned relatively lower than the first platen to facilitate a stepped media feed path with minimal distance between the first and second printheads.

7 Claims, 1 Drawing Sheet

SHEET FEED MECHANISM FOR PRINTER HAVING WIDE PRINT ZONE

CROSS-REFERENCE TO RELATED APPLICATIONS

This application claims priority to U.S. provisional application Ser. No. 62/213,265, filed Sep. 2, 2015, entitled "SHEET FEED MECHANISM FOR PRINTER HAVING WIDE PRINT ZONE," which is hereby incorporated herein by reference in its entirety.

FIELD OF THE INVENTION

This invention relates to a feed mechanism for a printer. It has been developed primarily for feeding sheets of print media at high-speed past a plurality of fixed printheads.

BACKGROUND OF THE INVENTION

The Applicant has developed a range of Memjet® inkjet printers as described in, for example, WO2011/143700, WO2011/143699 and WO2009/089567, the contents of which are herein incorporated by reference. Memjet® printers employ a stationary printhead in combination with a feed mechanism which feeds print media past the printhead in a single pass. Memjet® printers therefore provide much higher printing speeds than conventional scanning inkjet printers.

High-speed, single-pass inkjet printing requires accurate media handling, especially in the print zone of the printhead, in order to provide acceptable print quality. With fixed printheads of a given length, relatively wide print zones may be constructed by arranging printheads in a staggered overlapping array across the print zone. For example, an A3 print zone may be constructed by positioning a pair of A4 printheads in a staggered overlapping arrangement.

For relatively narrow print zones (e.g. A4 size or narrower), a system of entry and exit rollers in combination with a fixed media platen generally provides sufficient stability in the print zone for acceptable print quality (see, for example, U.S. Pat. No. 8,523,316, the contents of which are herein incorporated by reference).

However, for wider media widths and/or faster print speeds, more complex media feed mechanisms are usually required. For example, U.S. Pat. No. 8,540,361 describes a feed mechanism suitable for wideformat printing comprising a combination of a fixed vacuum platen, an upstream drive roller and a downstream vacuum belt mechanism. The printer described in U.S. Pat. No. 8,540,361 employs five printhead modules arranged in a staggered overlapping array across the print zone.

In other high-speed printers, vacuum belt mechanisms may be employed. However, vacuum belt mechanisms, which transport media through the print zone, are problematic for inkjet printing, because the belt may become fouled with ink during printing. Moreover, inkjet printheads typically perform a number of inter-page spits so as to reduce the frequency of maintenance interventions and endless belts are not amenable to inter-page spitting due to ink fouling.

It would be desirable to provide a printer having a feed mechanism suitable for feeding sheets of print media through print zones defined by a plurality of overlapping printheads.

SUMMARY OF THE INVENTION

In a first aspect, there is provided a printer comprising:

a first fixed printhead having a respective first print zone;

a first platen positioned in the first print zone;

a second fixed printhead postioned downstream of the first printhead relative to a media feed direction, the second printhead having a respective second print zone;

a second platen positioned in the second print zone;

an input roller assembly positioned upstream of the first platen, the input roller assembly being configured for feeding media sheets along a downward trajectory, relative to the first printhead, towards the first platen;

an intermediary roller assembly positioned between the first and second platens, the intermediary roller assembly being configured for receiving the media sheets from the first platen and feeding the media sheets along a downward trajectory, relative to the second printhead, towards the second platen; and an exit roller assembly positioned downstream of the second platen for receiving the media sheets from the second platen, wherein the second platen is positioned relatively lower than the first platen.

The printer of the present invention advantageously enables stable media handling through the first and second print zones whilst minimizing a distance between the print zones. As described in U.S. Pat. No. 8,523,316, sheets of print media can be stably fed through a print zone when they are driven downwards onto a platen positioned below the printhead. With a first printhead positioned upstream of a second printhead, a relatively complex sequence of rollers assemblies would be required between the respective first and second platens in order to receive the media sheet from the first platen, raise the sheet to a suitable input position for the second platen, and then drive the sheet downwards towards the second platen. A complex sequence of rollers between the first and second platens would necessarily increase the spacing between the first and second printheads; and this increased spacing potentially leads to alignment problems, especially when printing at high speeds.

However, in the present invention, with the second platen positioned relatively lower than the first platen, a "stepped" media path obviates the requirement for a complex roller system between the two platens. Typically, a single intermediary roller assembly comprising a pair of engaged intermediary rollers suffices to receive media sheets from the first platen and direct the sheets downwards onto the second platen. By simplifying this intermediary roller assembly, typically to a single pair of engaged intermediary rollers, the distance between the first and printheads in the media feed direction is minimized. This, in turn, minimizes alignment problems during printing.

Preferably, a nozzle plate of the second printhead is positioned relatively lower than a nozzle plate of the first printhead.

Preferably, the first and second printheads are positioned in an overlapping arrangement with respect to the media feed direction. Overlapping printheads enables printing onto relatively wider print zones than printheads aligned in the media feed direction. However, aligned printheads are, of course, still within the ambit of the present invention.

Preferably, each of the first and second platens is independently movable towards and away from their respective first and second printheads. For example, the platens may be platen modules liftably mounted on respective sleds, as described in U.S. Pat. No. 8,523,316, the contents of which are incorporated herein by reference. Each maintenance sled may comprise other modules, such as a wiper module for wiping a respective printhead and a capper module for capping a respective printhead when not in use.

Preferably, the input roller assembly comprises a pair of input rollers defining a first nip therebetween, wherein the first nip is positioned relatively higher than the first platen. Positioning the first nip relatively higher than the first platen enables the input roller assembly to drive media sheets downwards onto the first platen.

Preferably, the intermediary roller assembly comprises a pair of intermediary rollers (preferably a single pair of intermediary rollers) defining an intermediary nip therebetween.

Preferably, the intermediary nip is positioned relatively higher than the second platen. Positioning the intermediary nip relatively higher than the second platen enables the intermediary roller assembly to drive media sheets downwards onto the second platen.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
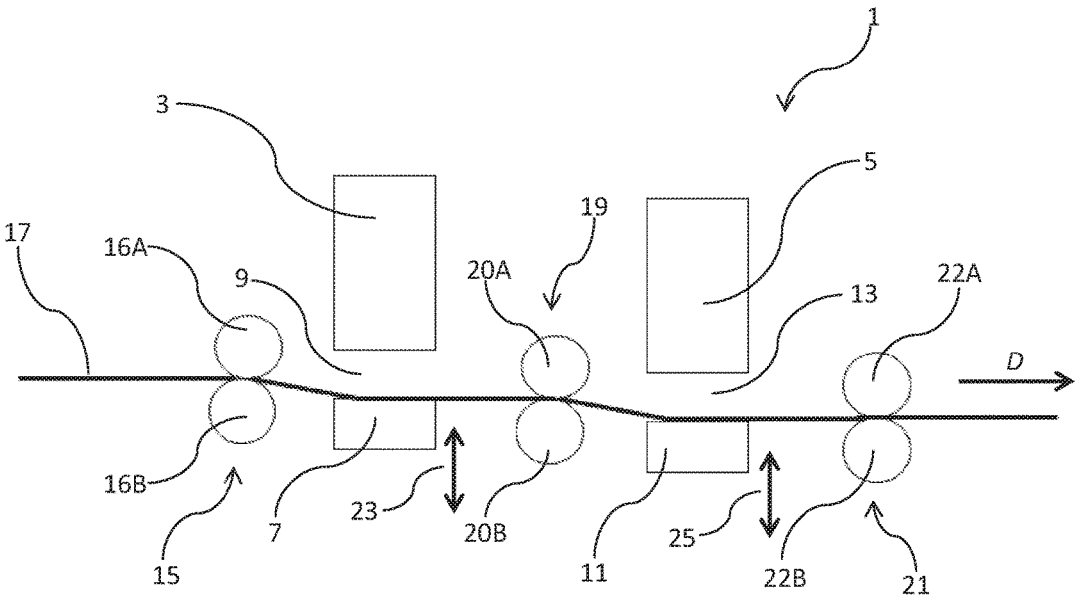
FIG. 1 is a schematic side view of a printer with printheads and feed mechanism according to the present invention.

Referring to FIG. 1, there is shown a printer 1 comprising a first fixed printhead 3 and a second fixed printhead 5 positioned downstream of the first printhead relative to a media feed direction D. A first platen 7 is positioned in a respective first print zone 9 of the first printhead 5. Similarly, a second platen 11 is positioned in a second print zone 13 of the second printhead 7.

An input roller assembly 15 is comprised of a pair of input rollers 16A and 16B positioned upstream of the first platen 7. The input roller assembly 15 receives a media sheet 17 and is configured to feed the sheet along the media feed direction (indicated by arrow D) in a generally downward trajectory onto an upper surface of the first platen 7. Accordingly, a nip defined between the input rollers 16A and 16B is positioned relatively higher than the upper surface of the first platen 7. The media sheet 17 is transported through the first print zone 9 and receives ink droplets from the first printhead 3 to form a first part of an image.

An intermediary roller assembly 19 is comprised of a pair of intermediary rollers 20A and 20B positioned downstream of the first platen 7 relative to the media feed direction D. The intermediary roller assembly 19 is configured for receiving the media sheet 17 from the first platen 7 and feeding the media sheet in a generally downward trajectory towards the second platen 11. Accordingly, a nip defined between the intermediary rollers 20A and 20B is positioned relatively higher than the upper surface of the second platen 11. The media sheet 17 is transported through the second print zone 13 and receives ink droplets from the second printhead 5 to form a second part of the image.

Figure 2:
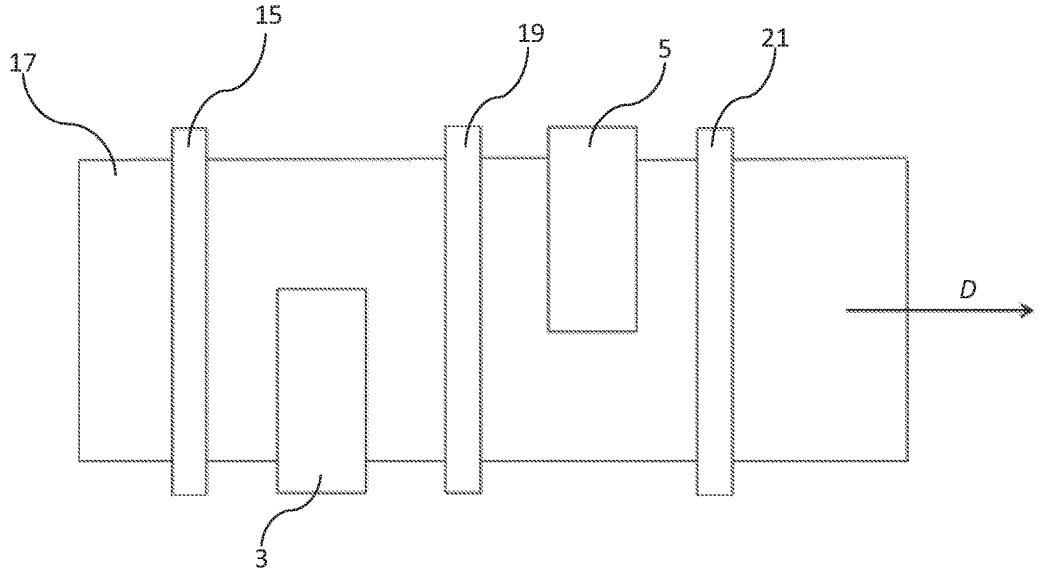
FIG. 2 is a schematic plan view of the printer shown in FIG. 1.

As shown in FIG. 2, the first printhead 3 and the second printhead 5 partially overlap in the media feed direction D, with each printhead printing about half of the image (not shown). Suitable algorithms may be employed to mask any stitching artifacts between the two printheads using techniques known in the art (see, for example, U.S. Pat. No. 6,394,573, the contents of which are incorporated herein by reference). Alternatively, the two parts of the image may be stitched by selecting a suitable stitching point for the two printheads and joining the two parts of the image via a simple butt join. These and other methods for stitching images printed by a plurality of fixed printheads will be readily apparent to the person skilled in the art.

Returning to FIG. 1, an exit roller assembly 21 is comprised of a pair of exit rollers 22A and 22B positioned downstream of the first platen 11 relative to the media feed direction D. The exit roller assembly 21 is configured for receiving the media sheet 17 from the second platen 11 and transporting the media sheet into an exit tray (not shown) of the printer 1.

The input roller assembly 15, intermediary roller assembly 19 and exit roller assembly 21 together form part of a media feed mechanism of the printer 1. The media feed mechanism may comprise other components, such as a media picker (not shown), as is known in the art.

Each of the roller assemblies 15, 19 and 21 may comprise a drive roller (e.g. rollers 16B, 20B and 22B) operatively connected to a drive mechanism (not shown). In one embodiment, an endless belt (not shown) may be employed to drive all drive rollers so as to maintain a constant roller speed and, hence, a constant media feed speed past the first and second printheads 3 and 5. Such an arrangement obviates the need for an individual encoder on each drive roller in the media feed mechanism.

From FIG. 1 it can be seen that the second platen 11 is positioned relatively lower than the first platen 7. As discussed above, this arrangement enables the media sheet 17 to be driven downwards into the each of the platens 7 and 11 in order to maintain stability in the first and second print zones 9 and 13. Moreover, by employing a stepped media feed path in this way, a distance between the first printhead 3 and the second printhead 5 is minimized by obviating more complex intermediary roller arrangements. Consequently, alignment between the first and second parts of the printed image is advantageously maximized.

As indicated by double-headed arrow 23, the first platen 7 may be liftable towards and away from the first printhead 3 to enable capping and/or maintenance interventions when required. Likewise, the second platen 11 may be liftable towards and away from the second printhead 5, as indicated by double-headed arrow 25. A suitable arrangement for lifting and translating a platen to enable maintenance and/or capping interventions is described in U.S. Pat. No. 8,523,316, the contents of which are incorporated herein by reference.

Although the present invention has been described with reference to two overlapping fixed printheads, it will of course be appreciated that the invention may be applicable to any number of printheads (e.g. three or more) arranged along a media feed path, irrespective of whether the printheads are overlapping, non-overlapping or aligned. With more printheads, each downstream platen is positioned relatively lower than an immediately upstream platen to enable a stepped media path between neighboring printheads in the media feed direction. For example, additional third and fourth printheads may be positioned between the first and second printheads, with an intermediary roller positioned between each printhead in the sequence. These and other arrangements having three or more printheads are within the ambit of the present invention.

It will, of course, be appreciated that the present invention has been described by way of example only and that modifications of detail may be made within the scope of the invention, which is defined in the accompanying claims.

The invention claimed is:

1. A printer comprising:

a first fixed printhead having a respective first print zone;

a first platen positioned in the first print zone;

a second fixed printhead positioned downstream of the first printhead relative to a media feed direction, the second printhead having a respective second print zone;

a second platen positioned in the second print zone;

an input roller assembly positioned upstream of the first platen, the input roller assembly being configured for feeding media sheets along a downward trajectory, relative to the first printhead, towards the first platen;

an intermediary roller assembly positioned between the first and second platens, the intermediary roller assembly being configured for receiving the media sheets from the first platen and feeding the media sheets along a downward trajectory, relative to the second printhead, towards the second platen; and an exit roller assembly positioned downstream of the second platen for receiving the media sheets from the second platen, wherein the second platen is positioned relatively lower than the first platen.

2. The printer of claim 1, wherein a nozzle plate of the second printhead is positioned relatively lower than a nozzle plate of the first printhead.

3. The printer of claim 1, wherein the first and second printheads are positioned in an overlapping arrangement with respect to the media feed direction.

4. The printer of claim 1, wherein each of the first and second platens are independently movable towards and away from their respective first and second printheads.

5. The printer of claim 1, wherein the input roller assembly comprises a pair of input rollers defining a first nip therebetween, wherein the first nip is positioned relatively higher than the first platen.

6. The printer of claim 1, wherein the intermediary roller assembly comprises a pair of intermediary rollers defining an intermediary nip therebetween, wherein the intermediary nip is positioned relatively higher than the second platen.

7. The printer of claim 1 comprising a single pair of intermediary rollers.

* * * * *